US011319789B2

(12) United States Patent
Gou et al.

(10) Patent No.: US 11,319,789 B2
(45) Date of Patent: May 3, 2022

(54) ROTARY DOWNHOLE CAVITATION GENERATOR

(71) Applicant: Southwest Petroleum University, Chengdu (CN)

(72) Inventors: Ruyi Gou, Chengdu (CN); Weiyu Chen, Chengdu (CN); Liqiang Zhao, Chengdu (CN); Pingli Liu, Chengdu (CN); Zhifeng Luo, Chengdu (CN); Nanlin Zhang, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 17/360,450

(22) Filed: Jun. 28, 2021

(65) Prior Publication Data

US 2022/0010665 A1 Jan. 13, 2022

(30) Foreign Application Priority Data

Jul. 8, 2020 (CN) ..... 202010649407.2

(51) Int. Cl.
*E21B 43/26* (2006.01)

(52) U.S. Cl.
CPC ..... *E21B 43/26* (2013.01)

(58) Field of Classification Search
CPC ..... E21B 43/26
(Continued)

(56) References Cited

U.S. PATENT DOCUMENTS 7,405,998 B2 * 7/2008 Webb ..... E21B 7/18 166/263
2010/0103768 A1 * 4/2010 Gordon ..... B01F 25/4335 366/165.4

(Continued)

FOREIGN PATENT DOCUMENTS

CN 102345441 A 2/2012
CN 105201482 A 12/2015

(Continued)

OTHER PUBLICATIONS

Xiangli, et al., "Reason analysis on plugging in polymeric damaged well and the technology of broken down", Oil Drilling & Production Technology, May 2011, pp. 70-73, vol. 33, No. 3. English Translation of Abstract.

(Continued)

*Primary Examiner* — Matthew R Buck
*Assistant Examiner* — Patrick F Lambe
(74) *Attorney, Agent, or Firm* — Cooper Legal Group, LLC

(57) ABSTRACT

The present disclosure discloses a rotary downhole cavitation generator, including an upper connector, a lower connector, and a casing. Said casing is internally provided with a transmission shaft, an alignment bearing, a drive assembly, a thrust bearing, a rotating disk, a rectification cylinder, an inner sleeve, and an outer sleeve. Said transmission shaft is provided with a deep hole, a diversion hole radially communicating with said deep hole, and a diversion channel radially communicating with said deep hole. Said alignment bearing and said drive assembly are sleeved on an upper end of said transmission shaft, and said rotating disk, said inner sleeve, and said thrust bearing are sleeved on a lower end of said transmission shaft. Said rectification cylinder and said outer sleeve are mounted on an inner wall of said casing, and (Continued)

said upper connector and said lower connector are respectively connected to both ends of said casing.

9 Claims, 4 Drawing Sheets

(58) Field of Classification Search
USPC ..... 166/177.5
See application file for complete search history.

(56) References Cited

U.S. PATENT DOCUMENTS

| | | | | |
|---|---|---|---|---|
| 2012/0043092 | A1* | 2/2012 | Arizmendi, Jr | E21B 34/06 166/330 |
| 2012/0118562 | A1 | 5/2012 | McAfee et al. | |
| 2019/0309623 | A1* | 10/2019 | Kletzel | E21B 47/24 |
| 2019/0330931 | A1 | 10/2019 | Zeng et al. | |
| 2020/0055010 | A1* | 2/2020 | Gordon | B01F 25/3131 |
| 2020/0392805 | A1* | 12/2020 | Kamler | E21B 28/00 |

FOREIGN PATENT DOCUMENTS

| | | | |
|---|---|---|---|
| CN | 107083942 | A | 8/2017 |
| CN | 107265563 | A | 10/2017 |
| CN | 110424933 | A | 11/2019 |
| WO | 0165049 | A2 | 9/2001 |

OTHER PUBLICATIONS

Davarpanah, et al., "Analysis of hydraulic fracturing techniques: hybrid fuzzy approaches", Arabian Journal of Geosciences, Jan. 25, 2018, pp. 1-8, vol. 12, Issue 402.

* cited by examiner

ROTARY DOWNHOLE CAVITATION GENERATOR

RELATED APPLICATIONS

The instant application claims priority to Chinese Patent Application 202010649407.2, filed on Jul. 8, 2020, which is incorporated herein by reference.

TECHNICAL FIELD

The present disclosure relates to a rotary downhole cavitation generator, belonging to the technical field of oil and gas field development engineering.

BACKGROUND

Hydraulic fracturing technology and matrix acidizing, important reservoir stimulation measures, are disadvantaged by complex processes, great technological barriers, high cost, and easy formation contamination. In recent years, physical oil recovery technologies without contamination to reservoir and environment have been extensively applied. Among them, reservoir stimulation by cavitation has become an important technology for permeability enhancement, blocking removal, blocking prevention, and water control in oil wells. With reservoir stimulation by cavitation, micro-fractures are produced in the pores of the formation rock by transient high temperature, high pressure, and shock waves under cavitation effect, enhancing the permeability of the rock, reducing the viscosity of the crude oil, and achieving the stimulation purpose.

The cavitation effect for oil and gas field stimulation is mainly generated by three methods: ultrasonic cavitation, low-frequency electric pulse cavitation, and hydraulic cavitation.

As for ultrasonic cavitation, the ultrasonic generator on the ground transmits high-power electric pulse signals to the bottom of the well, then the ultrasonic transducer at the bottom of the well converts the electrical signals to acoustic signals, and when the ultrasonic energy reaches a certain threshold, cavitation effect will occur to the fluid at the bottom of the well to realize the purpose of reservoir stimulation. However, the ultrasonic cavitation has the following disadvantages. 1. High energy threshold is required for ultrasonic cavitation and ultrasonic waves attenuate too quickly in the formation at the bottom of the well, consequently, the range of ultrasonic cavitation effect is restricted and the stimulation radius of ultrasonic cavitation is less than 20 m. 2. The ultrasonic cavitation generation system is complex structurally, including ground ultrasonic transmitter, downhole transmission cable, downhole ultrasonic transducer, and other devices. 3. The efficiency of ultrasonic energy conversion is limited. 4. The ultrasonic cavitation is not applicable to inclined wells.

As for low-frequency electric pulse cavitation, the downhole discharge string performs high-current pulse discharge, the high-voltage storage capacitor detonates the metal wire under the control of the pulse switch to deliver a strong shock wave to the formation, then the sudden change of the pressure and velocity of the shock wave will produce cavitation effect in the fluid in the formation to realize the purpose of reservoir stimulation. However, the low-frequency electric pulse cavitation has the following disadvantages. 1. The construction effect is limited by single pulse energy, discharge efficiency, and wire length. 2. The service life of the instrument is affected by high temperature, high pressure, and vibration at the bottom of the well. 3. The ultrasonic cavitation is not applicable to inclined wells.

The hydraulic cavitation generator usually comprises orifice plate, Venturi tube, nozzle, throttle valve, and other structures. When the liquid medium passes through the above-mentioned mechanical structure, a low-pressure cavitation zone will be generated. Cavitation bubbles are produced in the liquid to form a "two-phase" mixed flow. When the liquid carries the cavitation bubbles into the high-pressure zone, the cavitation bubbles collapse and generate extremely high pressure, high temperature, and micro-jets to achieve the purpose of stimulation. At present, self-vibration cavitation generators and fluid cavitation generators have been used in rock breaking and near-wellbore treatment in drilling, but they still have the following disadvantages.

1. The cavitation effect produced by the hydraulic cavitation generator is weak. 2. The conversion efficiency of fluid pressure energy is low.

SUMMARY OF THE DISCLOSURE

The disclosure proposes a rotary downhole cavitation generator with high energy conversion efficiency to overcome the shortcomings in the prior art.

The technical solution provided by the present disclosure to solve the above technical problems is a rotary downhole cavitation generator, comprising an upper connector, a lower connector, and a casing, said casing is provided with a transmission shaft, an alignment bearing, a drive assembly, a thrust bearing, a rotating disk, a rectification cylinder, an inner sleeve, and an outer sleeve.

Said transmission shaft is provided with a deep hole axially at an upper end of said transmission shaft, a diversion hole radially communicating with said deep hole at a middle of said transmission shaft, and a diversion channel radially communicating with said deep hole at the lower end of said transmission shaft.

Said alignment bearing comprises a stationary ring and a rotary ring, said drive assembly comprises a turbine stator and a turbine rotor, and said thrust bearing comprises an outer ring, an inner ring, and a steel ball mounted between said outer ring and said inner ring.

Said rotary ring of said alignment bearing and said turbine rotor of said drive assembly are sleeved on said upper end of said transmission shaft, and said rotating disk, said inner sleeve, and said inner ring of said thrust bearing are sleeved on said lower end of said transmission shaft in turn.

Said rectification cylinder and said outer sleeve are mounted on an inner wall of said casing, and said upper connector and said lower connector are respectively connected to both ends of said casing. Said stationary ring of said alignment bearing, said turbine stator of the drive assembly, said outer sleeve, said rectification cylinder, and said outer ring of said thrust bearing are pressed against said inner wall of said casing. Said transmission shaft is provided at each end with an upper hold-down component for pressing said rotary ring of said alignment bearing and said turbine rotor of said drive assembly and a lower hold-down component for pressing said rotating disk, said inner sleeve, and said inner ring of said thrust bearing, respectively.

Said rotating disk is provided with a swirling nozzle communicating with said diversion channel, said rectification cylinder is radially provided with a liquid flow grid, said casing is radially provided with a swirling flow outlet at a lower end of said casing, and said swirling nozzle, said liquid flow grid, and said swirling flow outlet are in a same horizontal position.

The further technical solution is that said upper hold-down component is an upper jam nut and said lower hold-down component is a lower jam nut.

The further technical solution is that said both of said liquid flow grid and said swirling flow outlet have a circular cross-sectional shape.

The further technical solution is that said both of said liquid flow grid and said swirling flow outlet have a cross-section with long narrow slit.

The further technical solution is that a cross-sectional area of said liquid flow grid is greater than a cross-sectional area of said swirling flow outlet.

The further technical solution is that the swirling nozzle is a converging nozzle.

The further technical solution is that there is a gap between said swirling nozzle and said liquid flow grid.

The further technical solution is that said rectification cylinder is provided with an annular raised step on an inner wall of an upper end of said rectification cylinder, there is a first gap between said annular raised step and an outer wall of said transmission shaft, said inner sleeve is provided with an annular step on an outer wall of said inner sleeve, and there is a second gap between said annular step and an inner wall of said rectification cylinder.

In the operation of the present disclosure, the fluid is pumped from the ground through tubing. Some fluid enters the turbine stator and turbine rotor to drive the turbine rotor to rotate and then flows into the swirling chamber of the rotating disk through the diversion hole of the transmission shaft. The other fluid directly flows into the swirling chamber of the rotating disk from the center of the transmission shaft. The rotating disk is driven by the turbine rotor to rotate at a high speed, and the swirling chamber in the rotating disk swirls the fluid at a high speed and ejects the fluid from the swirling nozzle under the action of centrifugal force and pressure. The swirling nozzle is highly consistent with the liquid flow grid of the rectification cylinder and the swirling flow outlet of the casing. The rotating disk is driven by the turbine rotor to rotate at a high speed, forming liquid flow with circulation, and at the same time, a low-pressure area is formed at the swirling nozzle, and it is easy for the fluid to be cavitated after passing through the rotating disk.

With the high-speed rotation of the swirling disk, the swirling nozzle of the swirling chamber periodically passes through the liquid flow grid and the swirling flow outlet, forming high-frequency liquid flow pulsation, which is conducive to the migration and collapse of cavitation bubbles, accordingly generating more effective cavitation effect that can produce local high temperature, high pressure, micro jet, and shock wave in the formation to make hard rocks slightly fractured. Under the repeated and periodic action of the cavitation effect, the permeability of the rock is enhanced and the connectivity of the reservoir with the wellbore is improved, realizing reservoir stimulation.

The present disclosure has the following beneficial effects:

1. The present disclosure can generate a strong cavitation effect under low pressure and low energy consumption to realize the purpose of permeability enhancement, blocking removal, enhanced oil production, and water control;

2. The present disclosure has the advantages of high energy conversion efficiency, large radiation radius of cavitation effect, and long duration of stimulation;

3. The present disclosure is a physical stimulation method which is green, safe, reliable, and environment-friendly, without contamination to formation and environment nor corrosion and damage to downhole equipment; and 4. The present disclosure, with convenient control and simple supporting equipment and construction process, can be applied to directional or horizontal wells.

Figure 1:
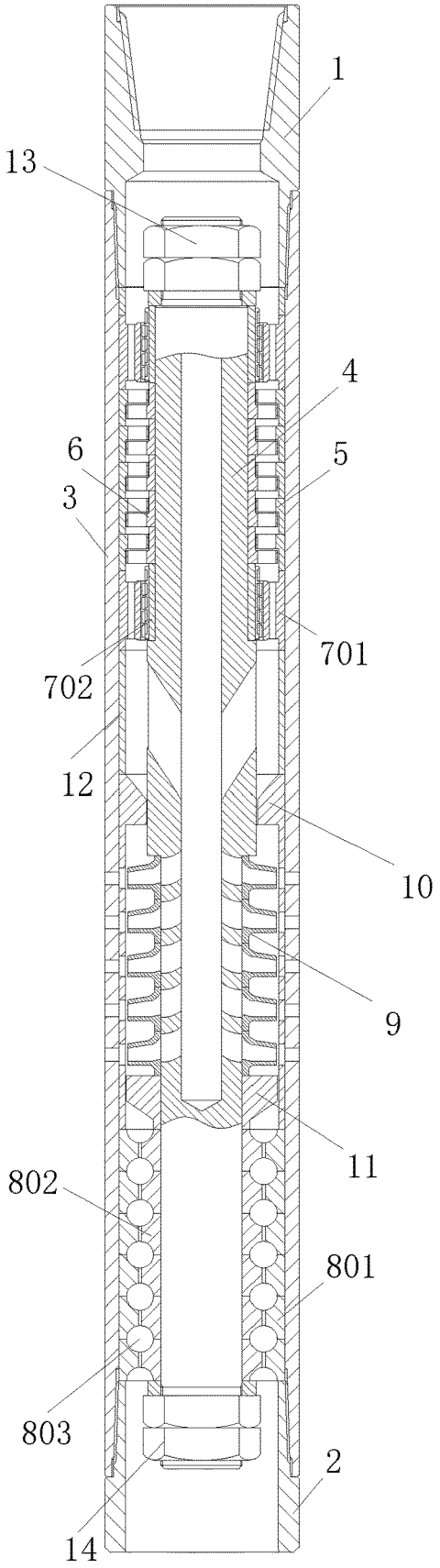
FIG. 1 is a structure diagram of the rotary downhole cavitation generator in the present disclosure.
Figure 2:
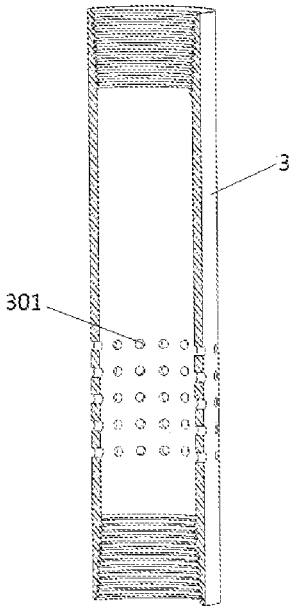
FIG. 2 is a semi-sectional view of the casing structure of the present disclosure.
Figure 3:
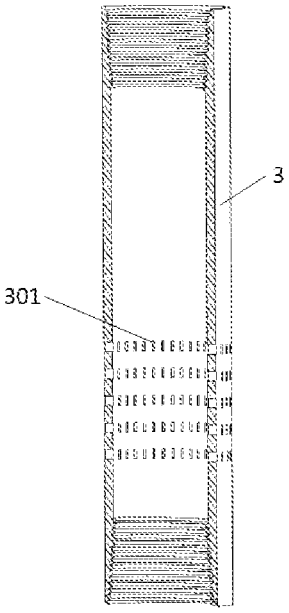
FIG. 3 is a diagram of another form of the structure shown in FIG. 2, with a long narrow slit on the cross-section of the swirling flow outlet.
Figure 4:
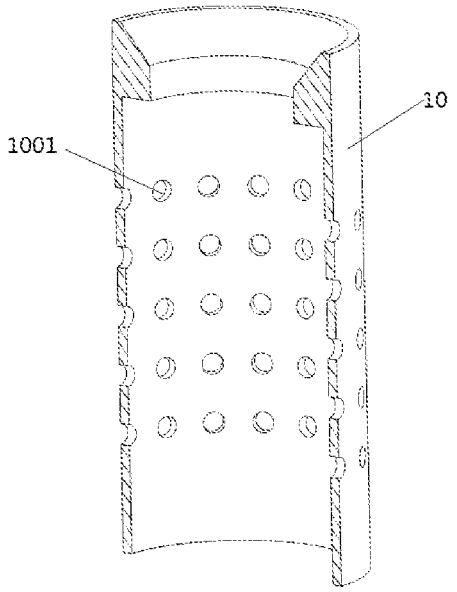
FIG. 4 is a semi-sectional view of the rectification cylinder structure of the present disclosure.
Figure 5:
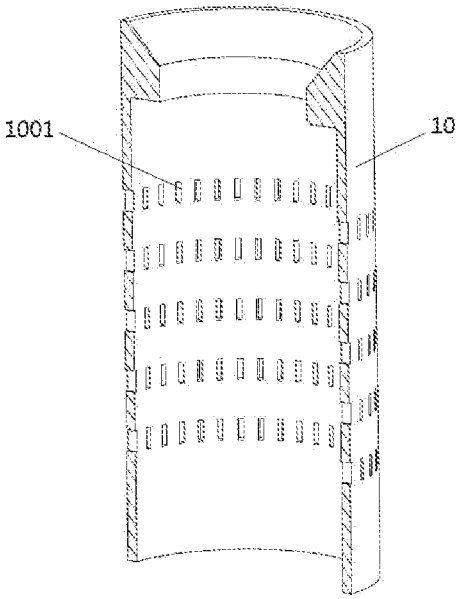
FIG. 5 is a diagram of another form of the structure shown in FIG. 4, with a long narrow slit on the cross-section of the liquid flow grid.

An explanation of reference numbers in the figures is as follows: 1—Upper Connector, 2—Lower Connector, 3—Casing, 301—Swirling Flow Outlet, 4—Transmission Shaft, 401—Deep Hole, 402—Diversion Hole, 403—Diversion Channel, 5—Turbine Stator, 6—Turbine Rotor; 701—Stationary Ring, 702—Rotary Ring, 801—Outer Ring, 802—Inner Ring, 803—Steel Ball, 9—Rotating Disk, 901—Swirling Chamber, 902—Swirling Nozzle, 10—Rectification Cylinder, 1001—Liquid Flow Grid, 11—Inner Sleeve, 12—Outer Sleeve, 13—Upper Jam Nut, and 14—Lower Jam Nut.

DETAILED DESCRIPTION OF THE PREFERRED EMBODIMENTS

The present disclosure will be further described with the following embodiments and figures.

As shown in FIGS. 1-7, a rotary downhole cavitation generator of the present disclosure comprises an upper connector 1, a lower connector 2 and a casing 3, and said casing 3 is provided with a transmission shaft 4, an alignment bearing, a drive assembly, a thrust bearing, a rotating disk 9 with a swirling chamber 901, a rectification cylinder 10, an inner sleeve 11, and an outer sleeve 12;

The upper end of said transmission shaft 4 is axially provided with a deep hole 401 of which a raised step is arranged at the middle. The raised step is radially provided with a plurality of diversion holes 402 communicating with the deep hole 401 and evenly distributed in the circumferential direction of the raised step. The lower end is radially provided with a plurality of diversion channels 403 communicating with the deep hole 401 and evenly distributed in the circumferential direction of the transmission shaft 4.

Said alignment bearing comprises a stationary ring 701 and a rotary ring 702, said drive assembly comprises a turbine stator 5 and a turbine rotor 6, and said thrust bearing comprises an outer ring 801, an inner ring 802, and a steel ball 803 mounted between said outer ring 801 and said inner ring 802. The rotary ring 702 of said alignment bearing and the turbine rotor 6 of said drive assembly are sleeved on the upper end of the transmission shaft 4, and the rotating disk 9, the inner sleeve 11, and the inner ring 802 of the thrust bearing are sleeved on the lower end of the transmission shaft 4 in turn.

Said rectification cylinder 10 and said outer sleeve 12 are mounted on the inner wall of the casing 3, and the upper connector 1 and the lower connector 2 are respectively connected to both ends of the casing 3. The stationary ring 701 of the alignment bearing, the turbine stator 5 of the drive assembly, the outer sleeve 12, the rectification cylinder 10, and the outer ring 801 of the thrust bearing are pressed against the inner wall of the casing 3 without rotational movement.

Said transmission shaft 4 is provided with upper and lower hold-down components at the upper and lower ends respectively. The upper hold-down component presses the rotary ring 702 of the alignment bearing and the turbine rotor 6 of the drive assembly on the upper end surface of the raised step of the transmission shaft 4. The lower hold-down component presses the inner ring 802 of the thrust bearing, the inner sleeve 11, and the rotating disk 9 in turn on the lower end surface of the raised step of the transmission shaft 4. The lower hold-down component presses the inner ring 802 of the thrust bearing, the inner sleeve 11, and the rotating disk 9 all rotate, so that the rotating disk 9 can rotate together with the turbine rotor 6 and the transmission shaft 4.

Said rotating disk 9 is provided with a plurality of swirling nozzles 902 communicating with the diversion channels 403. Said rectification cylinder 10 is radially provided with a plurality of liquid flow grids 1001 which are evenly distributed in the axial direction of the rectification cylinder 10. Said casing 3 is radially provided with a plurality of swirling flow outlets 301 at the lower end, which are evenly distributed in the axial direction of the casing 3. Said swirling nozzle 902, said liquid flow grid 1001, and said swirling flow outlet 301 are in the same horizontal position.

The work flow of this embodiment is that the upper connector 1 is connected to tubing, and the tubing will deliver high-pressure fluid from the ground to the cavitation generator during the reservoir stimulation operation. When the high-pressure fluid enters the cavitation generator, some directly enters the deep hole 401 of the transmission shaft 4, and the rest enters the turbine stator 5 and the turbine rotor 6, which is driven to rotate relative to the turbine stator 5 by the pressure energy of the high-pressure fluid. The turbine rotor 6 can drive the rotating disk 9 to rotate through the transmission shaft 4.

Figure 6:
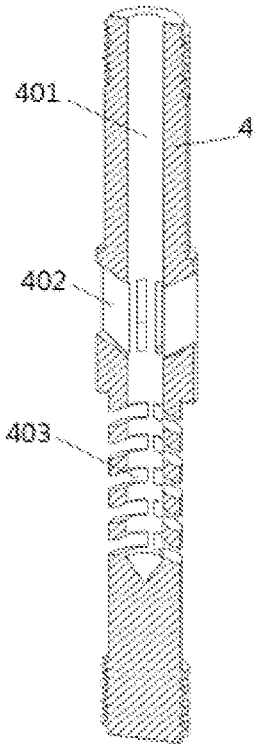
FIG. 6 is a schematic diagram of a half-section structure of the transmission shaft the present disclosure.
Figure 7:
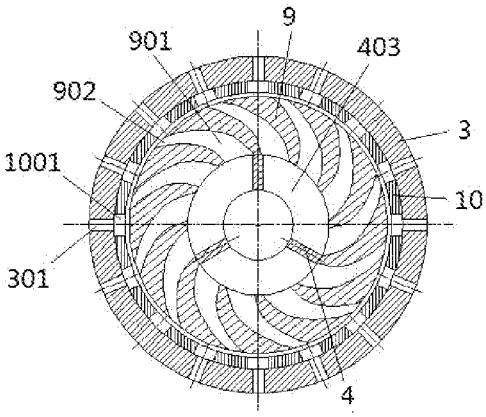
FIG. 7 is a schematic diagram of a cross-section of the flow channel of the rotating disk in the present disclosure.

As shown in FIGS. 1, 6, and 7, after the high-pressure fluid passes through the turbine stator 5 and the turbine rotor 6, the high-pressure fluid then flows into the deep hole 401 of the transmission shaft 4 through the diversion holes 402 and flows into the swirling chamber 901 through the diversion channels 403 in the lower part of the transmission shaft 4.

As shown in FIG. 7, while the rotating disk 9 rotates at a high speed, the swirling chamber 901 in the rotating disk 9 swirls the fluid at a high speed and ejects the fluid from the swirling nozzle 902 under the action of centrifugal force and pressure. Under the joint action of the high-speed flowing of the fluid and the converging swirling nozzle, a low-pressure area is formed at the swirling nozzle 902 and cavitation bubbles are generated in the fluid. The swirling nozzle 902 is highly consistent with the liquid flow grid 1001 and the swirling flow outlet 301. The rotating disk 9 rotates at a high speed relative to the rectification cylinder 10 and the casing 3. The swirling nozzle 902 periodically passes through the liquid flow grid 1001 and the swirling flow outlet 301, forming high-frequency fluid pulsation, which is conducive for the migration and collapse of cavitation bubbles.

The fluid enters into the formation through the swirling flow outlet 301, and cavitation bubbles collapse under the action of the flow pulsation, which generates a strong cavitation effect around cavitation bubbles. The effect of local high temperature, high pressure, micro-jets, and shock waves leads to tiny fractures on the rock surface of the formation, Under the repeated and periodic action of the cavitation effect, the rock is damaged cumulatively and then cracked more seriously, lengthening and deepening the fractures, which enhances the permeability of the rock and the connectivity of the reservoir with the wellbore, realizing reservoir stimulation.

As shown in FIG. 1, the upper and lower hold-down components are specifically the upper jam nut 13 and lower jam nut 14 in some embodiments.

As shown in FIGS. 2, 3, 4, 5, and 7, both said liquid flow grid 1001 and swirling flow outlet 301 have a cross-section with a long narrow slit. Said swirling nozzle 902 is a converging nozzle, and there is a gap between said swirling nozzle 902 and said liquid flow grid 1001. The cross-sectional area of said liquid flow grid 1001 is greater than that of the swirling flow outlet 301, stably maintaining cavitation bubbles in the fluid and preventing the cavitation generator from cavitation caused by premature collapse of cavitation bubbles.

In this embodiment, as shown in FIGS. 1 and 6, in order to ensure that most of the fluid between the casing 3 and the transmission shaft 4 flows into the deep hole 401 of the transmission shaft 4 through the diversion hole 402, said rectification cylinder 10 is provided with an annular raised step on the inner wall of the upper end and there is a gap between said annular raised step and the outer wall of the transmission shaft 4, so that the annular raised step can throttle down.

In order to ensure that the fluid ejected from the swirling nozzle 902 can flow into the ground from the liquid flow grid 1001 and the swirling flow outlet 301, said inner sleeve 11 is provided with an annular step on the outer wall. In order to effectively lubricate the thrust bearing, there is a gap set between said annular step and the inner wall of the rectification cylinder 10 to allow a little amount of fluid to flow through the gap into the thrust bearing and lubricate the thrust bearing.

The rotary downhole cavitation generator in the present disclosure can be sent to the bottom of the well through the tubing and can be repeatedly operated in different well intervals, effectively overcoming the defects of low energy conversion efficiency and weak cavitation effect of the existing cavitation technologies. The disclosure is a physical stimulation method which is green, safe, reliable, and environment-friendly, without contamination to formation and environment nor corrosion and damage to downhole equipment. The rotary downhole cavitation generator has the advantages of high energy conversion efficiency, large radiation radius of cavitation effect, and long duration of stimulation.

The above are not intended to limit the present disclosure in any form. Although the present disclosure has been disclosed as above with embodiments, it is not intended to limit the present disclosure. Those skilled in the art, within the scope of the technical solution of the present disclosure, can use the disclosed technical content to make a few changes or modify the equivalent embodiment with equivalent changes. Within the scope of the technical solution of the present disclosure, any simple modification, equivalent change and modification made to the above embodiments according to the technical essence of the present disclosure are still regarded as a part of the technical solution of the present disclosure.

What is claimed is:

1. A rotary downhole cavitation generator, comprising:

an upper connector, a lower connector, and a casing, wherein:

said casing is provided with a transmission shaft, an alignment bearing, a drive assembly, a thrust bearing, a rotating disk, a rectification cylinder, an inner sleeve, and an outer sleeve, said transmission shaft is provided with a hole axially at an upper end of said transmission shaft, a diversion hole radially communicating with said hole at a middle of said transmission shaft, and a diversion channel radially communicating with said hole at a lower end of said transmission shaft, said alignment bearing comprises a stationary ring and a rotary ring, said drive assembly comprises a turbine stator and a turbine rotor, said thrust bearing comprises an outer ring, an inner ring, and a steel ball mounted between said outer ring and said inner ring, said rotary ring of said alignment bearing and said turbine rotor of said drive assembly are sleeved on said upper end of said transmission shaft, said rotating disk, said inner sleeve, and said inner ring of said thrust bearing are sleeved on said lower end of said transmission shaft in turn, said rectification cylinder and said outer sleeve are mounted on an inner wall of said casing, said upper connector and said lower connector are respectively connected to both ends of said casing, said stationary ring of said alignment bearing, said turbine stator of said drive assembly, said outer sleeve, said rectification cylinder, and said outer ring of said thrust bearing are pressed against said inner wall of said casing, said transmission shaft is provided at each end with an upper hold-down component for pressing said rotary ring of said alignment bearing and said turbine rotor of said drive assembly and a lower hold-down component for pressing said rotating disk, said inner sleeve, and said inner ring of said thrust bearing respectively, said rotating disk is provided with a swirling nozzle communicating with said diversion channel, said rectification cylinder is radially provided with a liquid flow grid, said casing is radially provided with a swirling flow outlet at a lower end of said casing, and said swirling nozzle, said liquid flow grid, and said swirling flow outlet are in a same horizontal position.

2. The rotary downhole cavitation generator according to claim 1, wherein said upper hold-down component is an upper jam nut and said lower hold-down component is a lower jam nut.

3. The rotary downhole cavitation generator according to claim 1, wherein both of said liquid flow grid and said swirling flow outlet have a circular cross-sectional shape.

4. The rotary downhole cavitation generator according to claim 3, wherein a cross-sectional area of said liquid flow grid is greater than a cross-sectional area of said swirling flow outlet.

5. The rotary downhole cavitation generator according to claim 1, wherein both of said liquid flow grid and said swirling flow outlet have a cross-section with a slit.

6. The rotary downhole cavitation generator according to claim 5, wherein a cross-sectional area of said liquid flow grid is greater than a cross-sectional area of said swirling flow outlet.

7. The rotary downhole cavitation generator according to claim 1, wherein said swirling nozzle is a converging nozzle.

8. The rotary downhole cavitation generator according to claim 7, wherein there is a gap between said swirling nozzle and said liquid flow grid.

9. The rotary downhole cavitation generator according to claim 1, wherein:

said rectification cylinder is provided with an annular raised step on an inner wall of an upper end of said rectification cylinder, there is a first gap between said annular raised step and an outer wall of said transmission shaft, said inner sleeve is provided with an annular step on an outer wall of said inner sleeve, and there is a second gap between said annular step and an inner wall of said rectification cylinder.

* * * * *